United States Patent [19]

Johns et al.

[11] Patent Number: 4,832,676

[45] Date of Patent: May 23, 1989

[54] METHOD AND APPARATUS FOR FORMING PAPERBOARD CONTAINERS

[75] Inventors: Albert D. Johns, Roselle Park, N.J.; Patrick H. Wnek, Sherwood; Ronald P. Marx, Lakewood, both of Wis.

[73] Assignee: James River-Norwalk, Inc., Richmond, Va.

[21] Appl. No.: 111,116

[22] Filed: Oct. 21, 1987

Related U.S. Application Data

[63] Continuation of Ser. No. 938,858, Dec. 8, 1986, abandoned.

[51] Int. Cl.[4] ..... B31B 1/28; B31B 1/44

[52] U.S. Cl. ..... 493/152; 493/168; 493/171; 493/174; 493/902; 264/320

[58] Field of Search ..... 493/152, 154, 158, 167, 493/168, 171, 174, 902; 264/320, 322, 324, 325; 425/406, 394; 72/348, 350, 351, 353; 413/8, 56

[56] References Cited

U.S. PATENT DOCUMENTS

| | | | |
|---|---|---|---|
| 746,843 | 12/1903 | Jones | 72/348 |
| 1,575,300 | 3/1926 | Weeks et al. | 264/320 |
| 1,912,733 | 6/1933 | Simmons | 493/152 |
| 2,136,308 | 11/1938 | Miller | 493/152 |
| 4,127,378 | 11/1978 | Meadors | 425/394 |
| 4,225,553 | 9/1980 | Hirota et al. | 264/320 |
| 4,228,121 | 10/1980 | Meadors | 264/320 |
| 4,588,539 | 5/1986 | Rossi et al. | 264/320 |

*Primary Examiner*—Frederick R. Schmidt
*Assistant Examiner*—Robert Showalter
*Attorney, Agent, or Firm*—Finnegan, Henderson, Farabow, Garrett & Dunner

[57] ABSTRACT

A method and apparatus for forming a container from a sheet of blank material, whereby a segmented male die member first forms the bottom and then the sidewall and rim of the container prior to the formation of the lip portion of the container while the blank is being restrained in a radial direction by the engagement of the blank by two opposing draw pad members.

13 Claims, 5 Drawing Sheets

METHOD AND APPARATUS FOR FORMING PAPERBOARD CONTAINERS

This application is a continuation of U.S. patent application Ser. No. 06/938,858 filed on Jan. 8, 1986 and now abandoned.

BACKGROUND OF THE INVENTION

1. Field of the Invention

This invention relates to forming pressed paperboard products such as paper trays and plates and to the apparatus for forming such products.

2. Description of the Prior Art

Formed fiber containers, such as paper plates and trays, are commonly produced either by molding fibers from a pulp slurry into the desired form of the container or by pressing a paperboard blank between forming dies into the desired shape. The molded pulp articles, after drying, are fairly strong and rigid but generally have a rough surface and are not usually coated so that they are susceptible to penetration by water, oil and other liquids. Pressed paperboard containers, on the other hand, can be decorated and coated with a liquid resistant coating before being stamped by the forming dies into the desired shape. Pressed paperboard containers generally cost less and require less storage space than the molded pulp articles. Large numbers of paper plates and similar products are produced by each of these methods every year at relatively low unit cost. These products come in many different shapes, rectangular or polygonal as well as round, in multicompartment configurations.

Pressed paperboard containers tend to have somewhat less strength and rigidity than do comparable containers made by the pulp molding processes. Much of the strength and resistance to bending of a plate-like container made by either process lies in the side wall and rim areas which surround the center or bottom portion of the container. When in use, such containers are supported by the rim and side wall while the weight held by the container is located on the bottom portion. Thus, the rim and side wall generally is placed in tension when the container is being used.

In plate-like structures made by the pulp molding process, the side wall and overturned rim of the plate are unitary, cohesive fibrous structures which have good resistance to bending as long as they are not damaged or split. Because the rim and side wall of the pulp molded containers are of a cohesive, unitary structure, they may be placed under considerable tension without failing.

In contrast, when a container is made by pressing a paperboard blank, the flat blank must be distorted and changed in dimension in order to form the generally planar blank into the desired three dimensional shape. This necessary distortion results in seams or pleats in the sidewall and rim, the areas of the container which are reduced in press forming the container. These seams or pleats constitute material fault lines in the side wall and rim areas about which such containers bend more readily than do containers having unflawed side walls and rims. Moreover, such seams or pleats have a tendency to return to their original flat shape. The necessary location of these pleats in the side wall and rim of pressed paperboard containers places the greatest weakness in the area requiring the greatest strength. Such containers have been unable to support loads comparable to pulp molded containers since, when in use, the greater the load the higher the tension imposed on the rim and sidewall. Imposing tension on pleats merely enhances the tendency to flatten. Accordingly, known pressed paperboard containers have significantly less load carrying ability than do pulp molded containers. A pressed paperboard plate being less costly than its pulp molded competitor would have significant commercial value if it had comparable strength and ridigity.

Many efforts have been made to strengthen pressed paperboard containers while accommodating the necessary reduction in area at the side walls and rims. Blanks from which paperboard containers are pressed have been provided with score lines at their periphery to eliminate the random creation of seams or pleats. The score lines define the locations of the seams or pleats. Score lines, sometimes in conjunction with special die shapes, have been used to create flutes or corrugations in the sidewall and rim for aesthetic and structural purposes. The additional cost and complexity of dies used to create flutes or corrugations in the side wall of such containers is a cost disadvantage, and the containers are not significantly more rigid than prior paperboard containers.

Whether the area reduction of the side wall and rim is accommodated by pleats, seams, flutes or corrugations, the basic difficulty has been that under limited stress the paperboard will tend to return to its original shape.

To overcome this tendency, it has been suggested that the rim be subjected to various strengthening techniques. The earliest efforts comprised the addition of several thicknesses of paperboard at the rim. This container, however, required additional manufacturing steps and increased the cost and required storage space of the containers. Examples of this technique are disclosed in Moore, U.S. Pat. No. 2,627,051, and Bothe, U.S. Pat. No. 2,668,101.

Wilson, British Pat. No. 981,667, teaches subjecting the lip or rim of the container to pressure greater than that imposed on the rest of the container in the belief that the additional compression would resist the tendency of the rim to return to its original shape. While the rim of the device of Wilson is flattened, the side wall of the container is corrugated presenting the disadvantages referred to above.

More recently, as disclosed in a commonly-assigned, copending U.S. application, Ser. No. 764,965, filed Aug. 12, 1985, improved rigidity in a pressed paperboard container has been achieved by application of pressure and temperature to the rim of the container while applying substantially no pressure to the sidewall and bottom wall. In particular, the container had a generally planar bottom wall, a side wall upwardly rising from the bottom wall periphery and an overturned rim extending from the sidewall periphery. During integrally press-forming of the container, substantially no pressure was applied to the bottom and side walls and pressure was applied to the overturned rim. The amount of pressure imposed on the rim was approximately 200–250 psi and gradually increased from the juncture of the rim and side wall to the periphery edge of the rim. The pleats formed in the rim were compressed to the thickness of the rim while the pleats formed in the side wall were not subject to any significant pressure. The container thus formed provided a significant improvement over prior paperboard containers.

Another commonly-assigned, co-pending U.S. application, Ser. No. 697,888, filed Feb. 4, 1985, discloses a pressed paperboard container of improved strength and a method of making it. The paperboard container is comprised of a bottom wall, an upwardly extending side wall, a first curved portion joining the side wall to the periphery of the bottom wall, an outwardly extending rim, a second curved portion joining the rim to the periphery of the side wall, and a downwardly curved lip outwardly extending from the periphery of the rim. The container is integrally formed from a substantially homogeneous paperboard blank by a press such that the thickness of the side wall, second curved portion and rim is less than that of the bottom wall, first curved portion and lip. The container includes a plurality of densified regions radially extending through and circumferentially spaced about annular sections of the side wall, second curved portion and rim. The densified regions are formed from pleats including at least three layers of paperboard created during press forming of the blank which are subjected to sufficient pressure to reform the pleats into cohesive, fibrous structures having a density substantially greater than and a thickness substantially equal to adjacent areas of the side wall, second curved portion and rim. The application also discloses a method of forming containers from a flat, substantially homogeneous paperboard blank comprising shaping the blank into a formed container having a bottom wall, an upturned side wall extending from the bottom wall, a rim outwardly extending from the side wall and a lip downwardly extending from the rim and including pleats formed in the side wall, rim and lip. Sufficient heat an pressure are applied to the side wall and rim to decrease their cohesive fibrous structures having a density greater than and a thickness substantially equal to adjacent areas of the side wall and rim.

It is a principal object of the present invention to provide a method and an apparatus for forming a container from a blank of sheet material when the outer peripheral portion of the container is formed after the interior portion of the container, thereby reducing stress on the blank during its formation into the container. An additional object of the invention is to provide an apparatus for economically forming a container from a blank of sheet material. An additional object of the invention is to form a container from a blank of sheet material having a downturned lip portion that is unwrinkled. A further object of the invention is to form a container from a blank of sheet material without applying excessive pressure to the lip portion during formation.

Additional objects of the invention will be apparent from the following description of the preferred embodiments or can be learned by practice of the invention.

SUMMARY OF THE INVENTION

To achieve the above objects, there is provided an apparatus for forming a blank of sheet material into a container. The apparatus comprises a female die having bottom, lower radius, side wall, rim and downturned lip forming surfaces that generally define the shape of the container. The apparatus further includes draw pad means that are disposed to engage the outer peripheral edge of the blank during formation of the container and apply tension on the blank. The draw pad means comprise two opposite draw pad surfaces that are disposed to engage the opposite outer peripheral surfaces of the blank. A segmented male die member is axially movable into a mating relationship with the female die wherein segments of the male die member engage the blank on the surface of the female die sequentially. The segmented male die member comprises a first forming means that is axially movable into a mating relationship with the bottom and lower radius surfaces of the female die for forming the bottom and lower radius of the container. The segmented male die member further includes a second forming means axially movable separately from the first forming means into a mating relationship with the side wall and rim surface of the female die for forming the side wall and rim of the container. The apparatus further includes lip forming means axially movable into a mating relationship with the downturned lip forming surface of the female die. The apparatus further includes means for sequentially moving the first forming means and the second forming means axially to form the bottom and lower radius of the container prior to the lip forming means engaging the blank. Resilient means interconnect the first and second forming means, thereby allowing initial axial movement of the first and second forming means together and for delaying application of forming pressure on the side wall surface until after application of forming pressure on the bottom and lower radius surfaces. Means for resiliently biasing the draw pad surface are provided to axially engage the blank and maintain the blank in its initial plane during formation of the bottom, lower radius and side wall of the container. Preferably, the draw pad means is comprised of a lower annular draw pad surrounding the female die. The lower draw pad member has an upper draw pad surface with an indentation therein disposed to receive the outer peripheral edge of the blank.

Such an apparatus is disposed to form a container that includes a bottom surface, a lower radius, a side wall, a rim and a lip. Such a container is formed by holding the outer peripheral surface of the blank between two opposing surfaces such that the blank can retract radially upon application of a predetermined radial force on the blank. While the peripheral surface is radially restrained, the bottom surface of the container is formed. Subsequently, the lower radius, sidewall and rim are formed while the outer radial surface is restrained. The radial restraint is then released and thereafter the lip portion of the container is formed. Preferably, the two opposing surfaces maintain tension on the blank during at least a portion of the forming steps.

The present invention will now be disclosed in terms of a preferred embodiment, which is depicted in the accompanying drawings.

BRIEF DESCRIPTION OF THE DRAWINGS

The accompanying drawings, which are incorporated in and constitute a part of this specification, illustrate one embodiment of the invention and together with the description, serve to explain the principles of the invention.

DESCRIPTION OF THE PREFERRED EMBODIMENT

Reference will now be made in detail to the presently preferred embodiment of the invention, as example of which is illustrated in the accompanying drawings.

The present invention is a method and apparatus for forming paperboard containers from a blank of sheet material. The invention is most advantageous in the production of containers having a bottom surface, a lower radius, a sidewall, a rim and a downturned lip. However, other configurations of containers can be formed by the present invention. Typical products that can be advantageously produced by the present invention would include bowls and plates formed from sheet material. The embodiment disclosed herein forms a multi-compartment plate. The material comprising the formed product could be a number of common materials used in the production of such products such as coated or uncoated paper stock. The blank is depicted in the disclosed embodiment in FIG. 1 as the circular, disk-like blank 5.

Figure 1:
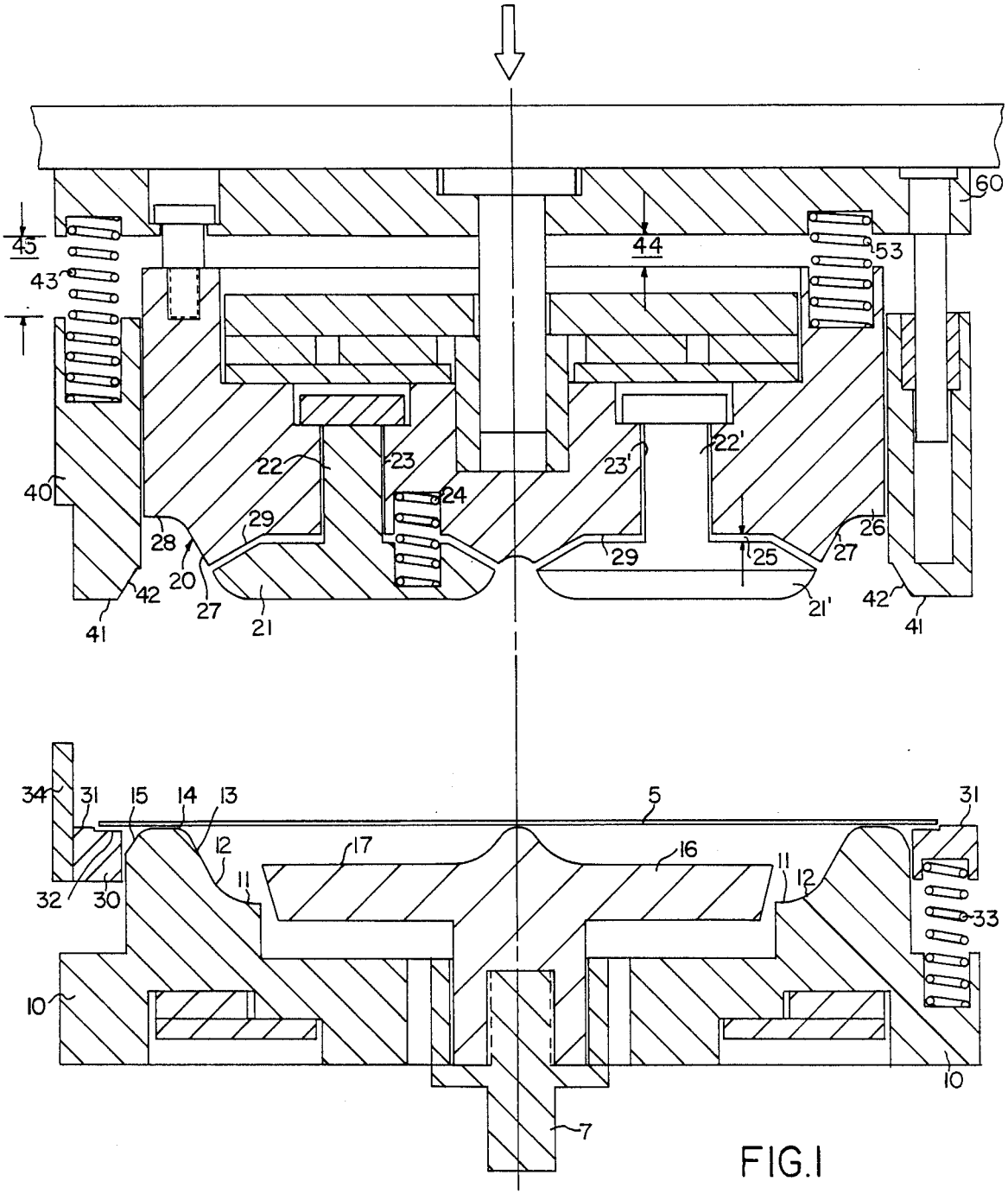
FIG. 1 is a cross-sectional schematic representation of an apparatus embodying the present invention with a planar blank placed within the apparatus.

In accordance with the invention, the apparatus includes a female die having bottom, lower radius, sidewall, rim and downturned lip forming surfaces generally defining the shape of the container. As here embodied and depicted in FIGS. 1 through 3, the lower female die 10 includes a bottom surface 11, a lower radius 12, a sidewall portion 13, a rim 14 and a downturned lip forming surface 15. The present embodiment includes a lower knockout 16, having an upper surface 17 that comprises a major portion of the bottom surface of the lower female die. The lower knockout functions to support the blank prior to forming, as shown in FIG. 1, and to facilitate ejection of the formed product.

The embodiment depicted is a schematic representation of the lower female die and such a die may include heaters, orifices for air release of the formed product and other features having significance with respect to the operation of the overall device independent of the operation of the present invention. One of ordinary skill in the art to which the invention pertains can incorporate such features into the present invention without a specific teaching herein.

In accordance with the invention, there is provided a segmented male die member that is axially movable into a mating relationship with the female die. Segments of the male die member engage the blank on the surface of the female die sequentially. It is the sequence of engagement of the male die with the blank in the female die that provides the benefits of the present invention. As disclosed above, when the proper sequence of engagement is utilized with respect to the male die, the lower surface, the lower radius sidewalls and rim of the container may be formed prior to formation of the downturned lip surface, thereby significantly reducing stress applied to the sheet material during formation. Segmented male die member is comprised of a first forming means axially movable into a mating relationship with the bottom and lower radius surfaces of the female die for forming the bottom and lower radius of the container.

As here embodied, the first forming means comprises a portion of the male die member 20. The two upper forming members 21 and 21′ are shown in cross-section in FIGS. 1 through 4. The blank engaging surfaces of the upper forming members 21 and 21′ should cooperate with the mating surfaces of the bottom surface 11 and 17 such that the surfaces of the blank 5, and hence the container, are appropriately shaped. As depicted in FIGS. 1 through 4, the upper forming members 21 and 21′ are axially movable with respect to the main body of the upper male die 20 by means of a central guide shaft 22 and 22′ within openings 23 and 23′ in the upper male die 20. Disposed between the upper forming members 21 and 21′ and the body of the upper male die 20 are resilient springs 24. The springs bias the upper forming members 21 and 21′ axially and means are included to limit axial movement of the central forming member with respect to the upper male die body such that there is a predetermined gap 25 between the upper male die body and the upper forming members. It is the function of the springs 24 and the gap 25 to provide engagement of the upper forming members 21 and 21′ with the blank 5 and the bottom surface 11 and an upper surface 17 prior to engagement of the portion of the upper male die that forms the sidewall portion of the container in cooperation with the sidewall portion 13 of the lower female die 10. Lower knockout 16 possesses pneumatically adjustable pressure which aids in the achievement of the proper sequence, the number of springs 24 (only one is depicted for clarity), their spring rates and the weight of the members 21 and 21′. Lower knockout 16 possesses pneumatically adjustable pressure which aids in the achievement of the proper sequence. As is most clearly depicted in FIG. 2, the upper forming members 21 and 21′ have engaged the blank 5 and forced it into conformance with the upper surface 17. In the disclosed embodiment of FIG. 2, just the bottom surface and compartments, including ribs separating compartments, are initially formed. Alternatively, the upper male die body can initially engage the lower radius 12 and form that portion of the article. In such a manner, those portions of the container are formed prior to the formation of the sidewalls, rim and lip.

The segmented male die member further comprises a second forming means axially movable separately from the first forming means into a mating relationship with the sidewall surface of the female die for forming the sidewall and rim of the container. As here embodied and most clearly depicted in FIGS. 1 through 4, the second forming means comprise an upper male die body 26 having a sidewall forming surface 27. Movement of the upper male die body 26 in the axial direction also moves the upper forming members 21 and 21′ inasmuch as they are engaged therewith. In the present embodiment, the upper male die body also includes a rim-forming portion. As here embodied, the upper male die body 26 includes a rim-forming portion 28. Although, the upper male die body may only have a sidewall forming surface 27 and the rim-forming portion of the upper male die may be located on another element of the segmented upper male die member. The upper male die body further includes engagement surfaces 29 which contact the upper forming members when the springs 24 have been sufficiently compressed to directly transmit force applied to the upper male die body to the upper forming members. While it is preferred that the surface 29 physically contact the surface of the upper forming members, the length or number of the springs 24 or their spring rates can be used to apply the necessary force to the upper forming members without the upper male die body contacting the upper forming members.

The apparatus further includes draw pad means that are disposed to engage the outer peripheral edge of the blank during forming of the container for applying tension and maintaining a level draw across the female die on the blank. The draw pad means comprise two opposite draw pad surfaces disposed to engage the opposite outer peripheral surfaces of the blank.

Figure 3:
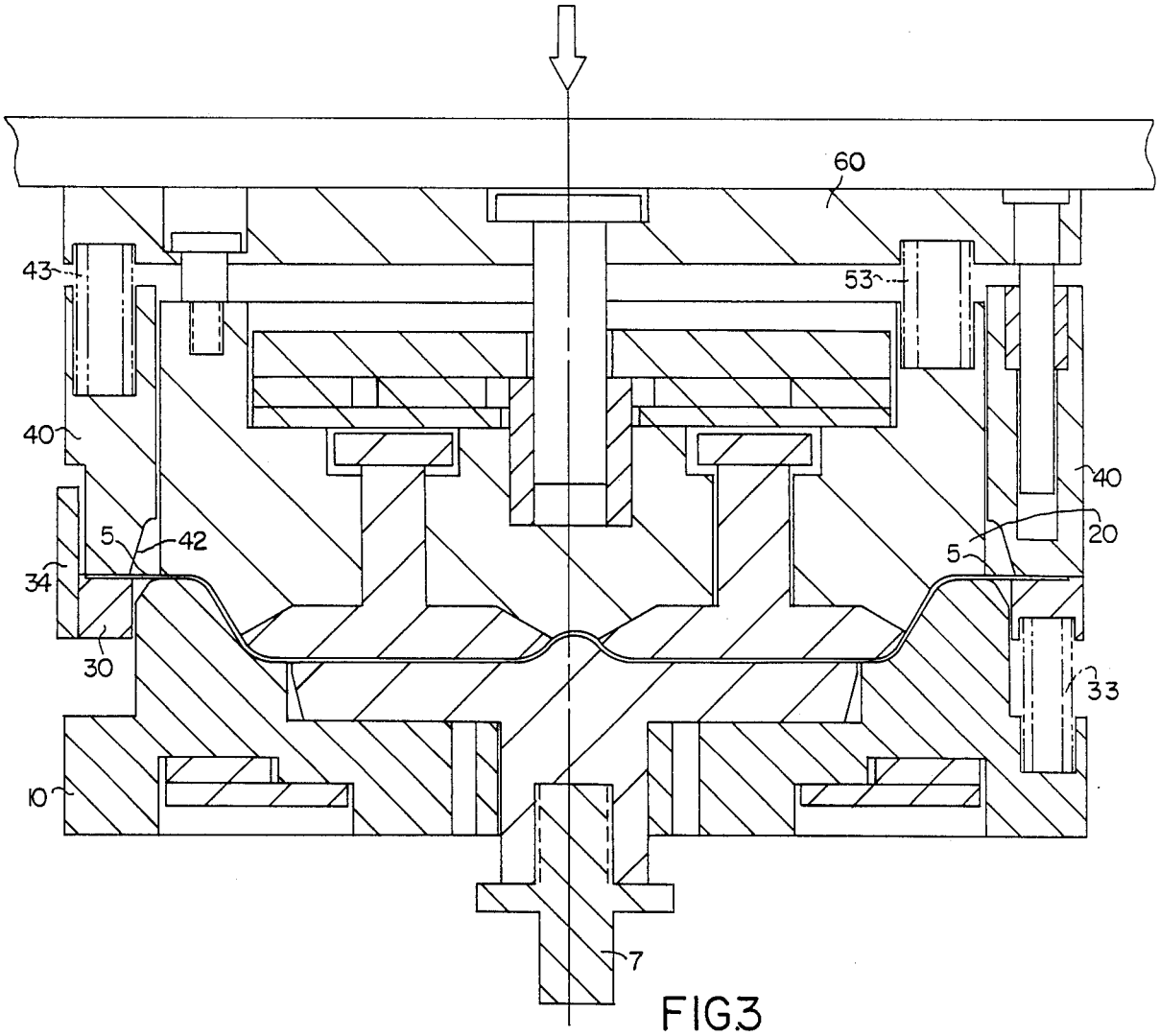
FIG. 3 is the embodiment of FIG. 1 wherein the apparatus has formed the bottom surface, side wall and rim of the container.
Figure 4:
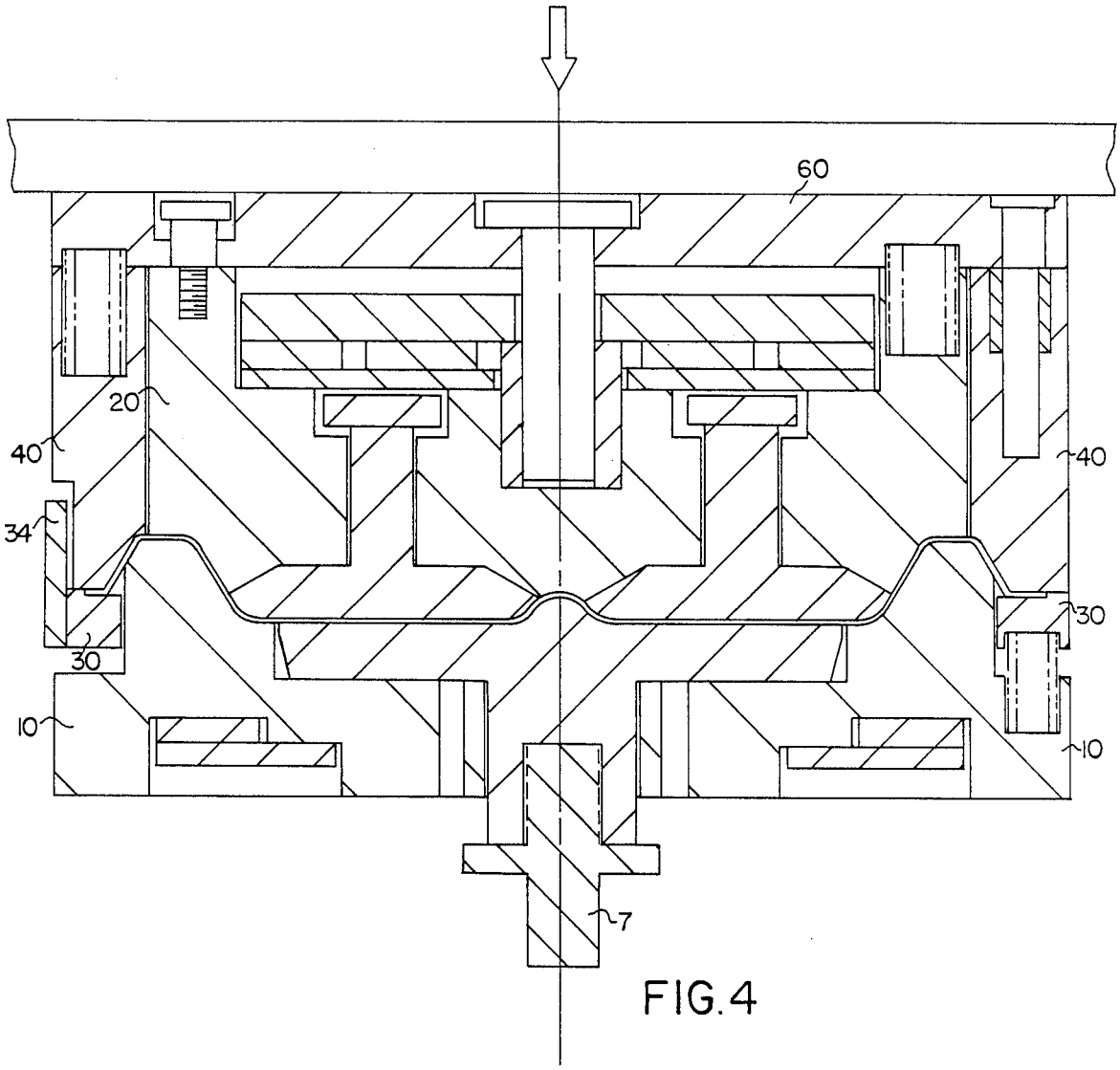
FIG. 4 is the embodiment of FIG. 1 wherein the apparatus has formed the downturned lip portion of the container.
Figure 5:
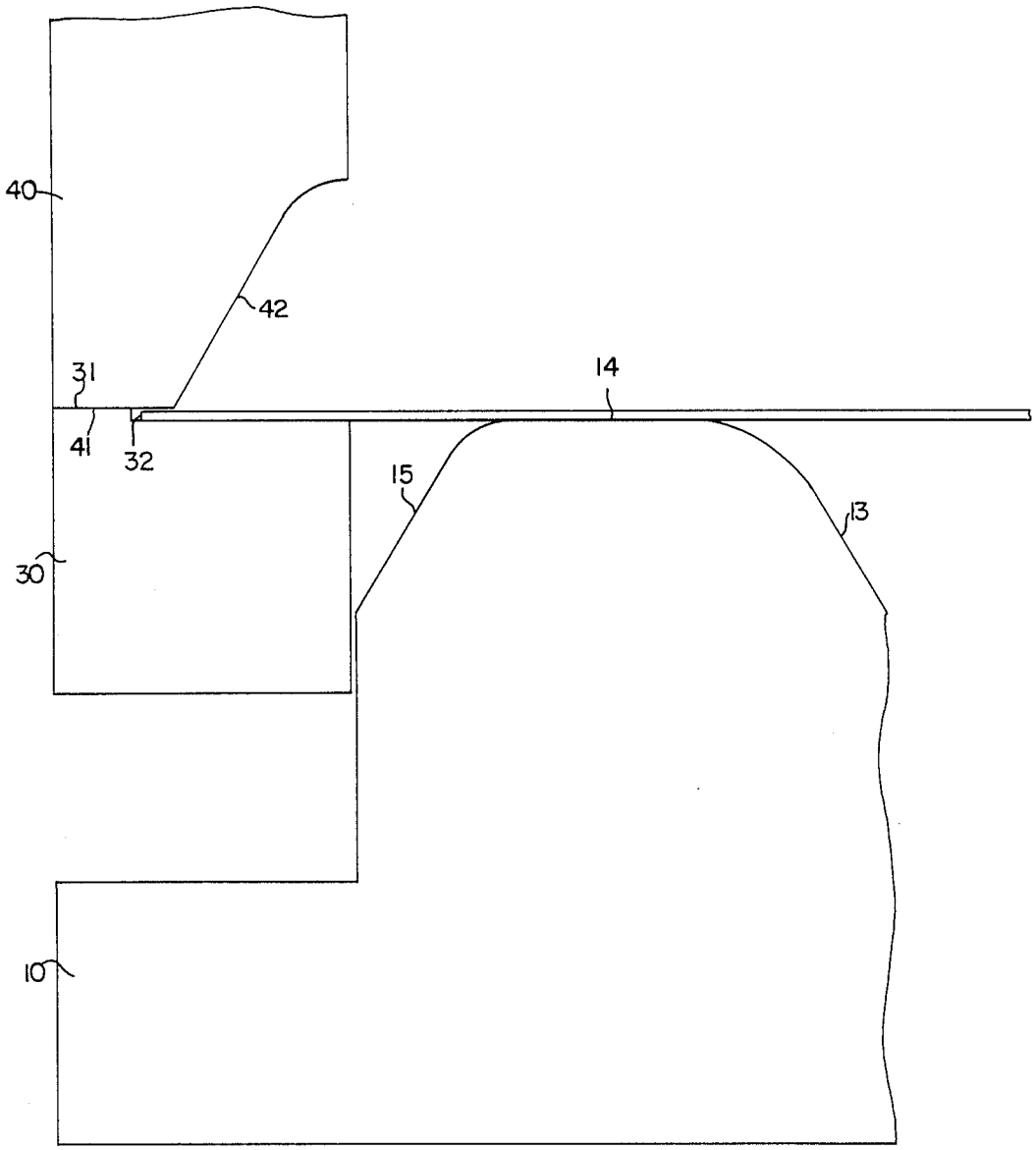
FIG. 5 is an enlarged schematic cross-sectional view of one portion of the embodiment of FIGS. 1 through 4.

As here embodied and depicted in FIGS. 1 through 4, the draw pad means comprise a lower annular draw pad member 30 that surrounds the lower female die 10. The lower draw pad member has an upper draw pad surface 31 and that surface has an annular indentation 32 therein. The indentation is disposed to receive the outer peripheral edge of the blank. Thus, as depicted in FIG. 5, when the blank is still in the planar condition, the outer edge of the blank is within the indentation on the upper draw pad surface and serves to locate the blank radially. In addition, the depth of the indentation 32 can be used to limit the pressure applied by the upper draw pad 40. As depicted in FIGS. 1 through 4, there are provided springs 33 disposed between the lower draw pad 30 and a portion of the female die 10. These springs 33 (only one of which is shown for clarity) have a combined spring rate that is greater than the force applied to the lower member 7. Thus, when the upper members 21 and 21' contact the blank lower knockout 16 with its upper surface 21 retracts into the lower female die 10. Other means not shown limit the upward travel of the lower draw pad member such that the surface of the indentation 32 is in line with the upper rim portion of the female die when the upper male die is fully retracted as shown in FIG. 5. As will be discussed in more detail hereinafter, an upper draw pad engages the lower draw pad and the blank forcing it downward with respect to the female die body by compression of the springs 43. The lower draw pad member can further include blank retaining means 34 shown here as an annular ring surrounding the lower draw pad. It may also be possible to use the lower draw pad without an indentation where the blank fits adjacent the outer retaining means and is restrained radially by that member. Preferably, the draw pad means includes an upper draw pad member 40 having an annular configuration surrounding the first and second forming means, as embodied herein, the upper forming members 21 and 21' and the upper male die body 20. As here embodied, the upper draw pad member 40 includes a blank engaging surface 41 disposed to move axially into engagement with the blank. As depicted in FIGS. 1 through 4, axial movement of the upper male die member brings the surface 41 into contact with the upper surface of the blank confining the blank between the surface 41 and the surface of the indentation 32. In such a manner, the blank is restrained from moving radially during formation of the container. In such a manner, stresses are reduced on the blank during the formation of the sidewall rim and lip portion thereby providing a stronger container.

As here embodied, the upper draw pad member includes a portion for forming the lip portion of the container. The lip-forming portion 42 is immediately adjacent the draw pad surface 41 and cooperates with the lip-forming portion 15 of the lower female die 10 to form the lip portion of the container. As here embodied, the upper draw pad 40 includes springs 43 disposed between a portion of the upper male die body 26 and the annular upper draw pad 40. It is the function of these springs to displace the upper draw pad axially such that the draw pad surfaces 41 and 32 engage the blank prior to any significant deformation of the blank to form the container. This is accomplished by controlling the combined spring rate of the springs 43, with respect to the combined spring rate of the springs 53, the axial position of the upper draw pad 40, the axial travel of the upper draw pad until it engages the abutting portion of the upper male die body shown as the space 45 and the space 44 between the upper platen 60 and the upper male die member 20. The relationship between the radial extent of the upper die body 26 and the upper draw pad 40 is not known to be critical. The upper draw pad 40 can be configured such that it forms the upper portion of the sidewall, as well as the rim and lip portion as depicted in FIGS. 1 and 4. As here embodied, the combined spring rate of spring 43 (only one of which is shown for clarity) is less than the combined spring rate of spring 53 (only one of which is shown for clarity) and springs 33 so that upon contact of the surface 41 with the lower drawpad upper surface 31, the blank 5 will be engaged but further movement of the upper male die member 20 will not force the lower draw pad 30 downwardly until axial movement of the upper male die member eliminates space 44, whereupon the lip of the container will begin to be formed.

As depicted in FIG. 5, it is preferred that the upper draw pad means move axially to engage the upper surface of the blank at a blank engaging position, that position being above the rim surface of the lower die by approximately the thickness of the blank. In such a manner, the blank is radially restrained during deformation of the blank to form the central portions of the container.

In accordance with the invention, there is further included a means for sequentially moving the first forming means and the second forming means axially to form the bottom and lower radius of the container prior to the lip forming means engaging the blank. As discussed hereinbefore, the upper forming members 21 and 21' and the bottom and sidewall forming portions of the upper male die body 26 are disposed to fully engage the blank and the lower female die member prior to engagement of the lip forming surfaces.

As is apparent by a comparison of FIGS. 3 and 4, when the central male die member 20 has moved downwardly a sufficient distance to form all but the lip portion of the container, the space 44 is eliminated and the upper and lower drawpads are moved downwardly with respect to the fully engaged upper male die 20 and the lower female die 10. In such a manner, the lip forming surface 42 of the upper draw pad 40 engages the blank 5 and forces it into conformance with the lip forming surface 15 of the lower female die 10. Thus, the downturned lip of the container is formed after all other portions of the container have been formed.

Operation of the Preferred Embodiment

Figure 2:
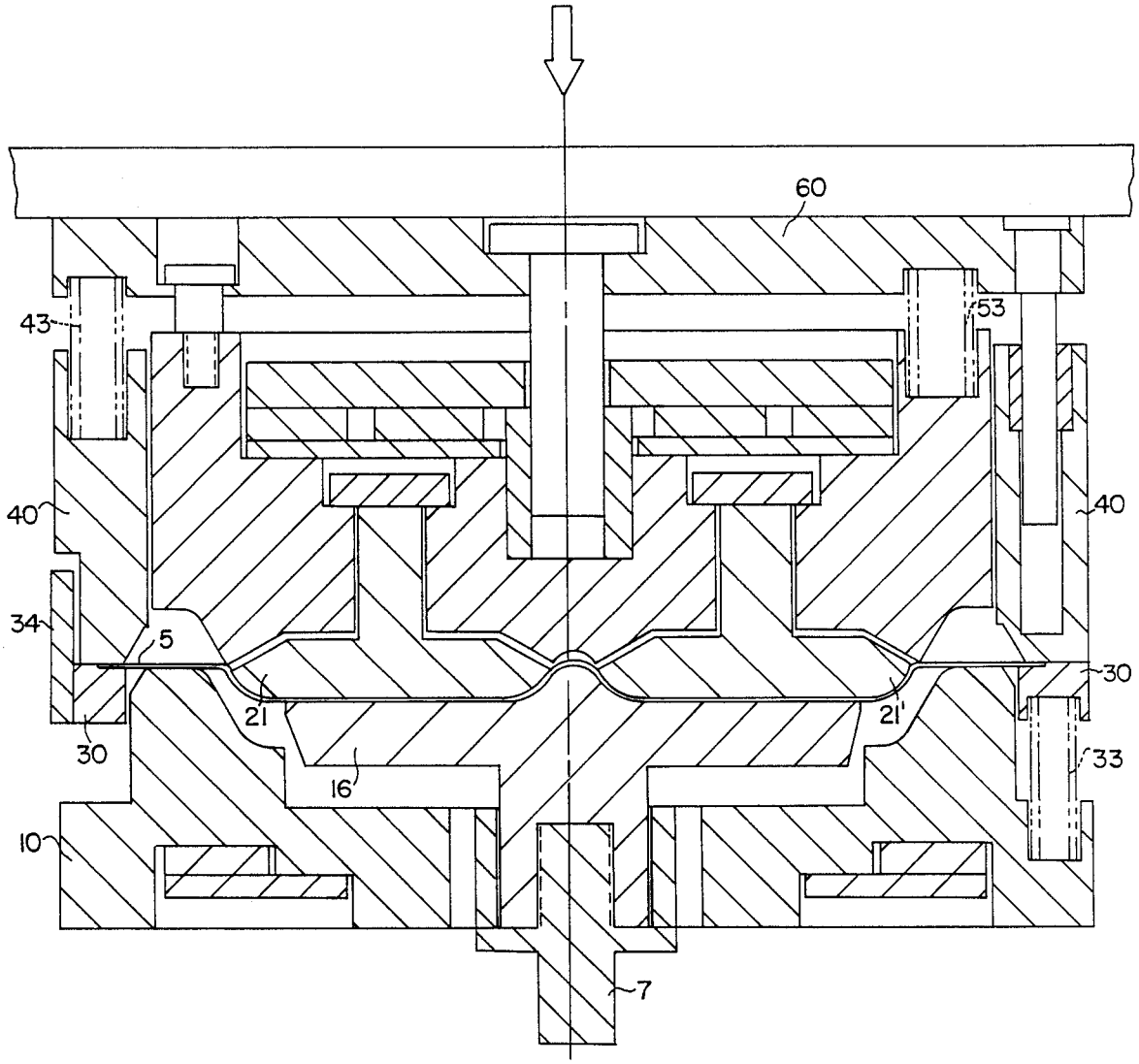
FIG. 2 is the embodiment of FIG. 1 wherein the apparatus has formed the central compartments of the container.

By means of the above-described mechanism, there is provided a method for forming a blank of sheet material into a container. The container including a bottom surface, lower radius, sidewall, a rim and a lip. As shown in FIG. 1, the blank 5 is placed on the lower female die 10 between the outer retainer members 34 within the notches 32. As shown in FIG. 2, the male die member 20 and the upper draw pad member 40 advance toward the lower female die 10 to engage the blank 5 on the upper forming surface 17 with the upper forming member 21 and 21'. Thus, in this operation, the bottom surface of the container, including compartments, are formed during this step. Initially as shown in FIG. 2, the springs used to bias the upper forming members 21 and 21' exert a force less than the controlled pneumatic force applied to the member 7. Thus, the lower knockout 16 remains in the extended position shown in FIGS. 1 and 2. As shown in FIG. 2, the upper drawpad member has moved into engagement with the lower drawpad member thereby engaging the outer peripheral surface of the blank between opposing surfaces of the drawpads. Friction of the blank 5 along the surfaces of the upper and lower drawpads confining it exerts a predetermined radial restraining force on the blank during the forming process. The magnitude of the restraining force is determined by the spring rates of springs 33 and 43 and the dimensions of the notch 32 in relation to the thickness of the blank. As shown in FIG. 3, further application of force to the assembly forces the upper male die member 20 downwardly into the lower female die forming the lower radius, sidewall and rim of the container. The lower radius, sidewall and rim are formed with the radial restraint on the outer peripheral surface of the blank 5 as previously described. With the lower knockout 16 in the fully retracted position and the upper die member 20 fully engaged into the lower female die 10, continued downward movement of the platen 60 closes the space 44 between the upper surface of the upper male die member and the upper platen 60. Upon closure of that surface, the upper platen 60 engages the upper surface of the upper drawpad 40 and as shown in FIG. 4, the lip forming surface 42 of the upper drawpad 40 engages the blank 5 and forces into conformance with the lip forming surface 15 of the lower male die, thus forming the downturned lip. With all the components in the configuration of FIG. 4, the rim continues to advance a predetermined amount through the designed shut height of the seated die assembly thereby ironing the formed container within the die.

Thus, through operation of the device disclosed herein, any central compartments are formed prior to the creation of the sidewall stresses caused by closed clearances between the male and female die set thus forming the central portions of the container without the application of detrimental stress to other portions of the blank. In such a manner, the final configuration of the die set used to form the container can have a thickness less than the blank being formed without the reduced clearances between the die set causing detrimental stresses during the formation of the container. This prevents corner tearing and fiber separation in high stress areas of the blank being formed. In addition, by controlling the pneumatic pressure of the ejection apparatus embodied here as the lower knockout 16 and utilizing the first stage of the male die member in conjunction with the radial restraint of the blank during initial forming critical high stress areas can be initially formed in the container in advance of the added stresses introduced by the later forming stages.

The present invention has been disclosed in terms of a preferred embodiment and a preferred manner of operation. The scope of the invention is not to be confined thereto and should be defined solely by the appended claims and their equivalents.

What is claimed is:

1. An apparatus for forming a blank of sheet material into a container, said apparatus comprising:

(a) a die set including a female die being segmented and having bottom, lower radius, side wall, rim and downturned lip-forming surfaces generally defining the shape of said container;

(b) draw pad means disposed to engage the outer peripheral edge of said blank placed in an initial plane during formation of said container for applying tension to said blank, said draw pad means including two opposite draw pad surfaces disposed to engage the opposite outer peripheral surfaces of said blank;

(c) said die set further including a segmented male die member axially movable into mating relationship with said female die wherein said segments of said male die member engage said blank on the surface of said female die sequentially, said segmented male die member comprising:

first forming means axially movable into mating relationship with said bottom and lower radius surfaces of said female die for forming said bottom and lower radius of said container;

second forming means axially movable separately from said first forming means into mating relationship with said side wall surfaces and rim of said female die for forming the side wall and rim of said container;

lip-forming means axially movable into mating relationship with said downturned lip-forming surface of said female die;

(d) means for sequentially moving said first forming means and second forming means axially to form the bottom, lower radius, side wall and rim of said container prior to said lip-forming means engaging said blank;

(e) first resilient means interconnecting said first and second forming means for allowing initial axial movement of said first and second forming means together, and for delaying application of forming pressure on said side wall surface until after application of forming pressure on said bottom and lower radius surfaces; and, (f) means for resiliently biasing said draw pad surfaces axially to engage said blank and maintain the peripheral edge of said blank in said initial plane during formation of the bottom, lower radius, side wall and rim of said container.

2. The apparatus of claim 1 wherein said draw pad means comprise a lower annular draw pad member surrounding said female die, said lower draw pad member having an upper draw pad surface, said upper draw pad surface having an indentation therein disposed to receive the outer peripheral edge of said blank.

3. The apparatus of claim 2 wherein said draw pad means includes resilient means disposed between said lower draw pad member and a portion of said female die.

4. The apparatus of claim 1 wherein said draw pad means includes an upper draw pad member; said upper draw pad member being an annular member surrounding said first and second forming means; said upper draw pad member having a blank engaging surface disposed to be moved axially into engagement with said blank.

5. The apparatus of claim 4 wherein said die set includes resilient means disposed between said upper draw pad member and a platen located above said second forming means.

6. The apparatus of claim 4 wherein said upper draw pad member includes at least a portion of said lip-forming means.

7. The apparatus of claim 4 wherein said upper draw pad means moves axially to engage with the upper surface of said blank at a blank engaging position, wherein said blank engaging position is above the rim surface of said lower die.

8. The apparatus of claim 1, further comprising second resilient means extending between said second forming means and platen located above said second forming means.

9. The apparatus of claim 2 wherein said die set includes means for maintaining said lower draw pad surfaces and said blank at an axial position at a level with the surface of said rim of said female die prior to engagement of said first forming means with said female die.

10. The apparatus of claim 1 wherein said female die includes, at said bottom surface, means for moving a portion of said bottom surface axially.

11. The apparatus of claim 10 wherein said movable portion of said bottom surface of said female die may be disposed at an axial position level with the surface of said rim of said female die.

12. A method of forming a blank of sheet material into a container utilizing a sequentially engageable segmented female die including bottom, lower radius, side wall rim and downturned lip-forming surfaces and a segmented male die including a first forming means and a second forming means, wherein said container includes a bottom, a lower radius, a side wall, a rim and a lip, said method comprising the steps of:

(a) holding the outer peripheral surface of said blank between two opposing surfaces such that said blank can retract radially upon application of a predetermined radial force on said blank;

(b) engaging said first forming means with said bottom and lower radius surfaces to form the bottom and lower radius of said container while said outer peripheral surface is radially restrained;

(c) engaging said second forming means with said side wall and rim surfaces to form the side wall and rim of said container subsequent to forming the bottom and lower radius of said container while said outer peripheral surface of said blank is radially restrained; and, (d) releasing radial restraint on said blank and thereafter forming said lip portion.

13. The method of claim 12 wherein said two opposing surfaces maintain tension on said blank during a least a portion of said forming steps.

* * * * *